US007499669B2

(12) United States Patent
Adachi et al.

(10) Patent No.: US 7,499,669 B2
(45) Date of Patent: Mar. 3, 2009

(54) TRANSFER UNIT AND IMAGE FORMING APPARATUS

(75) Inventors: Tomoya Adachi, Osaka (JP); Atsushi Takehara, Kyoto (JP)

(73) Assignee: Ricoh Company, Ltd., Tokyo (JP)

( * ) Notice: Subject to any disclaimer, the term of this patent is extended or adjusted under 35 U.S.C. 154(b) by 230 days.

(21) Appl. No.: 11/620,930

(22) Filed: Jan. 8, 2007

(65) Prior Publication Data

US 2007/0160396 A1 Jul. 12, 2007

(30) Foreign Application Priority Data

Jan. 11, 2006 (JP) ..... 2006-003225

(51) Int. Cl.
*G03G 15/01* (2006.01)

(52) U.S. Cl. ..... 399/302; 399/308

(58) Field of Classification Search ..... 399/107, 399/110, 121, 297, 298, 299, 302, 308
See application file for complete search history.

(56) References Cited

U.S. PATENT DOCUMENTS

| | | | | |
|---|---|---|---|---|
| 6,249,304 | B1 | 6/2001 | Sawayama et al. | |
| 6,292,206 | B1 | 9/2001 | Takehara et al. | |
| 6,295,438 | B1 | 9/2001 | Fujishiro et al. | |
| 6,334,039 | B1 | 12/2001 | Yoshinaga et al. | |
| 6,366,754 | B1 | 4/2002 | Sato et al. | |
| 6,782,227 | B2 | 8/2004 | Ishibashi et al. | |
| 7,003,238 | B2 | 2/2006 | Yoshida et al. | |
| 7,058,324 | B2 * | 6/2006 | Shibuya et al. | 399/49 |
| 7,139,497 | B2 | 11/2006 | Takehara | |
| 7,149,443 | B2 * | 12/2006 | Konishi | 399/49 |
| 2004/0109709 | A1 | 6/2004 | Ishibashi et al. | |
| 2005/0013636 | A1 | 1/2005 | Sawai et al. | |
| 2005/0147424 | A1 | 7/2005 | Kato et al. | |
| 2006/0170936 | A1 | 8/2006 | Takehara | |
| 2006/0210326 | A1 | 9/2006 | Takehara et al. | |
| 2006/0210327 | A1 | 9/2006 | Iwakura et al. | |
| 2006/0257176 | A1 | 11/2006 | Kawasaki et al. | |
| 2007/0160396 | A1 | 7/2007 | Adachi et al. | |

FOREIGN PATENT DOCUMENTS

| | | |
|---|---|---|
| JP | 2002-351228 | 12/2002 |
| JP | 2004-29057 | 1/2004 |
| JP | 2004-326085 | 11/2004 |
| JP | 2005-10701 | 1/2005 |
| JP | 2006-284664 | * 10/2006 |

OTHER PUBLICATIONS

U.S. Appl. No. 12/135,490, filed Jun. 9, 2008, Miyazaki.

* cited by examiner

*Primary Examiner*—Hoan H Tran
(74) *Attorney, Agent, or Firm*—Oblon, Spivak, McClelland, Maier & Neustadt, P.C.

(57) ABSTRACT

Latent images of different colors are superimposed on an intermediate transfer belt of an endless type from image carriers, to form a full color toner image. A tension roller maintains a tension of the intermediate transfer belt. A driving roller drives the intermediate transfer belt. A biasing unit applies the tension to the tension roller. A holding unit holds the tension roller. An image reading sensor detects the toner image formed on the intermediate transfer belt. The image reading sensor is disposed in the holding unit, in an opposite position to the tension roller with respect to the intermediate transfer belt.

7 Claims, 3 Drawing Sheets

TRANSFER UNIT AND IMAGE FORMING APPARATUS

CROSS-REFERENCE TO RELATED APPLICATIONS

The present document incorporates by reference the entire contents of Japanese priority document, 2006-003225 filed in Japan on Jan. 11, 2006.

BACKGROUND OF THE INVENTION

1. Field of the Invention

The present invention generally relates to a transfer unit and an image forming apparatus, and more specifically, to a transfer unit and an image forming apparatus including a plurality of image carriers and an endless transfer belt.

2. Background Technologies

Recently, downsizing of an image forming apparatus has been emphasized. Technologies for the above purpose include the image forming apparatus that adopts a method by which a toner image for each color on a plurality of image carriers are sequentially transferred onto an intermediate transfer belt, and then are transferred to a transfer medium, in one process.

An example of the conventional image forming apparatus is explained in FIG. 5. The image forming apparatus in the example includes an image creating unit, including four photoreceptors or photoreceptors 11, 12, 13, and 14, and in which a tension of an intermediate transfer belt 10 is maintained by a driving roller 21, a tension roller 22, and an opposing secondary transfer roller 19. A full-color image is formed by sequentially transferring each color onto the intermediate transfer belt 10 by applying a predefined voltage from an upstream of a driven direction of the intermediate transfer belt 10 to primary transfer rollers 15, 16, 17, and 18. The formed full-color image is transferred to a transferred material or a sheet 24, by applying the predefined voltage to a secondary transfer roller 20, and then is fixed (not shown) and output. A residue of the toner that remains on the intermediate transfer belt 10 after the image transfer by the secondary transfer roller 20 is collected by a cleaning unit 23.

In the image forming apparatus above, an image reading sensor is disposed to improve an accuracy of a transfer position for each color transferred sequentially to the intermediate transfer unit by detecting gaps present between the positions of the transferred colors. Conventionally, the image reading sensor is disposed facing against a fixed roller such as a driving roller and a driven roller, for ensuring the accuracy in detection.

Japanese Patent Application Laid-Open No. 2004-326085 describes an image reading sensor disposed facing against an intermediate transfer belt, for constantly reading a toner image on the intermediate transfer belt with high accuracy, and easily positioning the image reading sensor.

Other technologies have been proposed for downsizing the device. Japanese Patent Application Laid-Open No. 2002-351228 describes an integration of a tension roller and a cleaning unit of an image forming apparatus including a plurality of image carriers, a belt member contacting the image carriers, a tension roller that maintains a tension of the belt member, a biasing unit that applies tension to the tension roller, a holding unit that supports the tension roller by an axis enabling the tension roller to freely rotate, and a cleaning unit for the belt member installed in the holding unit that contacts the tension roller via the belt member.

Japanese Patent Application Laid-Open No. 2005-010701 describes an image forming apparatus in which a tension roller and a detecting unit that detects a quantity of elongation of a transfer belt are integrated. Japanese Patent Application Laid-Open No. 2004-29057 describes an image forming apparatus in which a recording paper to which a toner image is transferred is fixed by applying heat and a pressure with a fixing device disposed at a relatively upper position to a secondary transfer roller in a transfer path of a vertical path configuration, while a lower plane of the intermediate transfer belt is formed facing against photoreceptor drums and disposed in an inclined manner with the secondary transfer roller side downward.

Japanese Patent Application Laid-Open No. 2004-326085 limits a positioning of an image reading sensor, requires a roller for the image reading sensor, and may require a unit that moves a secondary transfer roller to and away from the intermediate transfer belt, causing an issue of a size enlargement of the intermediate transfer unit. Japanese Patent Application Laid-Open Nos. 2002-351228, 2005-010701, and 2004-29057 do not consider the image reading sensor as an approach relating to downsizing of the image forming apparatus, causing an issue that the device including the image reading sensor is unable to achieve sufficient downsizing.

SUMMARY OF THE INVENTION

It is an object of the present invention to at least partially solve the problems in the conventional technology.

A transfer unit according to one aspect of the present invention includes a plurality of image carriers on which latent images of different colors are formed, respectively; an intermediate transfer belt of an endless type, on which the latent images are superimposed to form a full color toner image; a tension roller that maintains a tension of the intermediate transfer belt; a driving roller that drives the intermediate transfer belt; a biasing unit that applies the tension to the tension roller; a holding unit that holds the tension roller; and an image reading sensor that detects the toner image formed on the intermediate transfer belt. The image reading sensor is disposed in the holding unit, in an opposite position to the tension roller with respect to the intermediate transfer belt.

An image forming apparatus according to another aspect of the present invention includes a transfer unit that transfers a toner image formed thereon to a recording medium. The transfer unit includes a plurality of image carriers on which latent images of different colors are formed, respectively; an intermediate transfer belt of an endless type, on which the latent images are superimposed to form a full color toner image; a tension roller that maintains a tension of the intermediate transfer belt; a driving roller that drives the intermediate transfer belt; a biasing unit that applies the tension to the tension roller; a holding unit that holds the tension roller; and an image reading sensor that detects the toner image formed on the intermediate transfer belt. The image reading sensor is disposed in the holding unit, in an opposite position to the tension roller with respect to the intermediate transfer belt.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE EXEMPLARY EMBODIMENTS

Exemplary embodiments according to the present invention are described in detail below with reference to the accompanying drawings.

Figure 1:
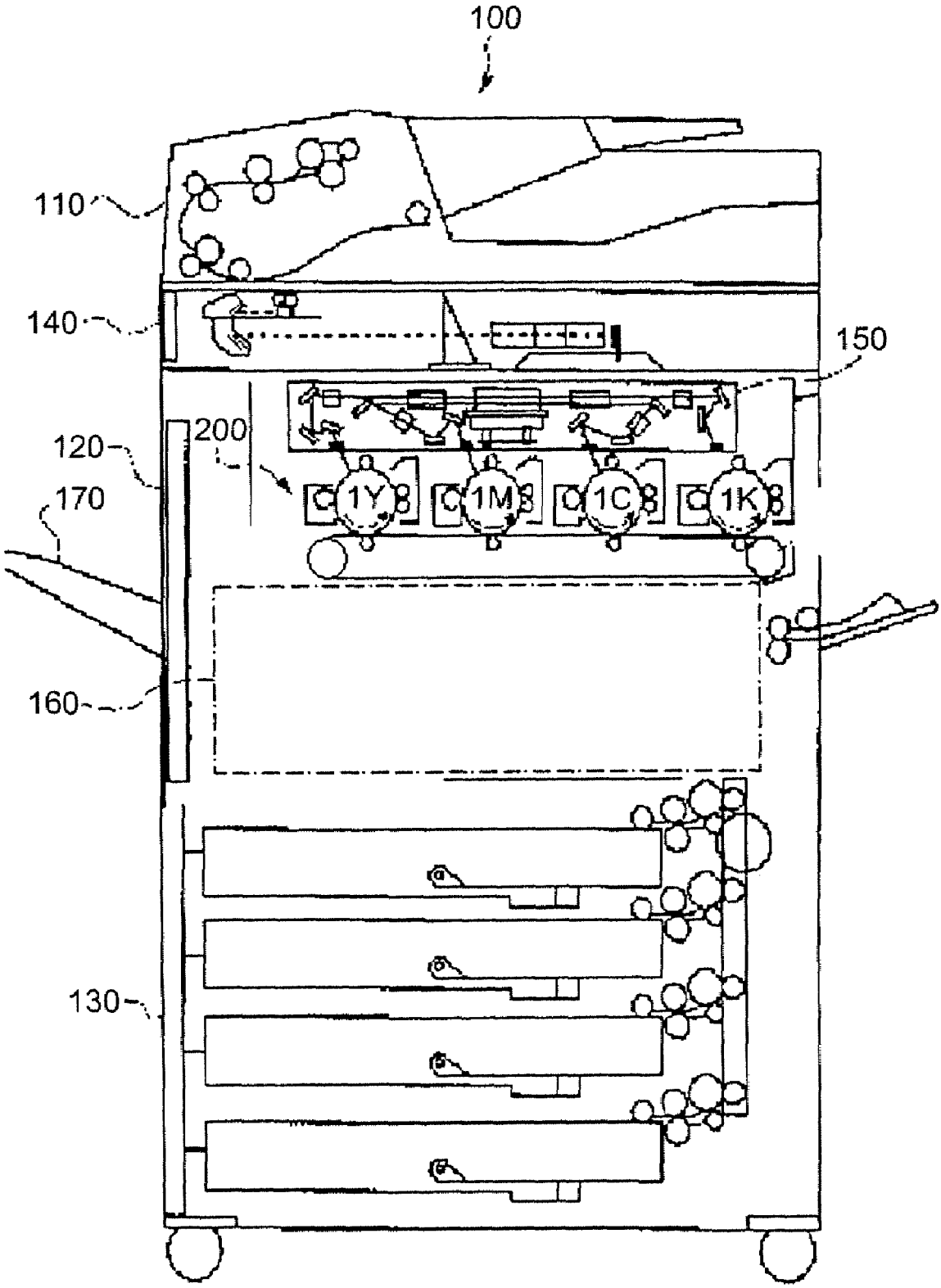
FIG. 1 is a schematic diagram of an image forming apparatus according to the present invention.

FIG. 1 is a schematic diagram of an image forming apparatus 100 according to the present invention. The image forming apparatus 100 is, for example, a full-color copying machine. As shown in FIG. 1, the image forming apparatus 100 includes, as main components, a document conveying unit 110, an image forming unit 120, a paper feeding unit 130, and a document reading unit 140. The image forming unit 120 includes a transfer unit 200, an exposure device 150, and a fixing device are disposed. In the transfer unit 200, four units, each of which is for creating a toner image with four colors, or black (K), cyan (C), magenta (M), and yellow (Y), are disposed in a tandem array. At a center of each unit, photoreceptors 1K, 1C, 1M, and 1Y are included respectively, and a charging device, a developing device, cleaning unit are disposed in a peripheral of the photoreceptors.

The exposure device 150 forms an electrostatic latent image by converting data scanned by the document reading unit 140 or image signals sent from an external device such as a computer (not shown) and for example, scans laser beam by a polygon motor, based on the image signals scanned through a mirror, onto the photoreceptor 1. The transfer unit 200 includes an intermediate transfer belt that carries a full-color toner image created by sequentially overlapping the four toner images formed on the photoreceptors 1K, 1C, 1M, and 1Y respectively, and transfers the full-color toner image formed on the intermediate transfer belt to a recording sheet or the like. The fixing device includes, as main components, a belt, a tension of which is maintained by a roller including, for example, a halogen heater, and a pressing roller, and fixes the transferred toner image on the recording sheet by applying heat and pressure to the toner image at a nipping unit comprising the belt and the roller. The fixing device can includes a pair of rollers or a pair of the belts, instead. The image forming apparatus 100 also includes an inversion unit 160 for double-sided printing and a delivery tray 170.

Figure 2:
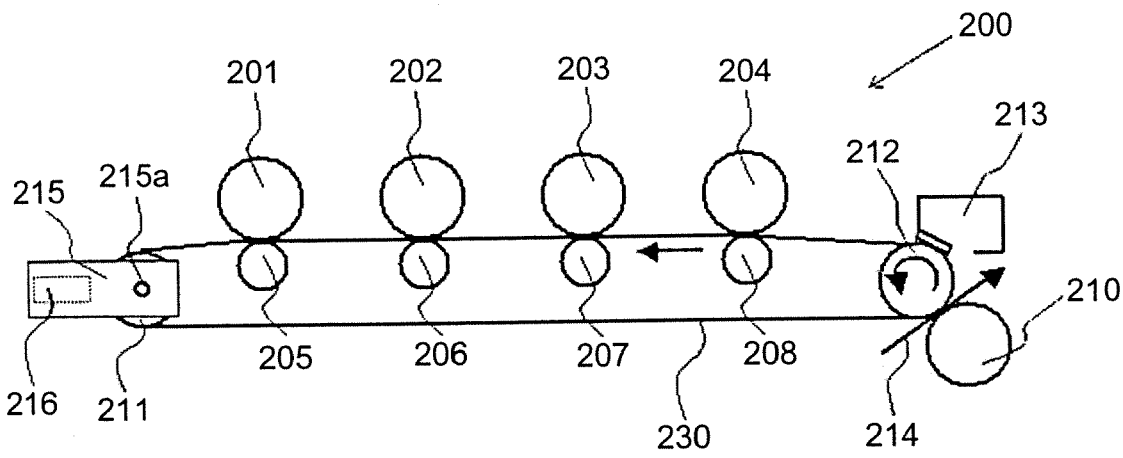
FIG. 2 is a schematic diagram of a transfer unit according to a first embodiment of the present invention.

FIG. 2 is a schematic diagram of the transfer unit 200 according to a first embodiment of the present invention. The transfer unit 200 includes, as image carriers, photoreceptors 201, 202, 203, and 204, which correspond to the photoreceptors 1K, 1C, 1M, and 1Y described above respectively, primary transfer rollers 205, 206, 207, and 208 that are located opposing to the photoreceptors 201, 202, 203, and 204, respectively and charges a predefined voltage, and an intermediate transfer belt 230 having an endless transfer belt. The tension of an intermediate transfer belt 230 is maintained by a tension roller 211 and a driving roller 212, and the toner for each color on the photoreceptors 201, 202, 203, and 204 is transferred to the intermediate transfer belt 230. A predefined tension is applied to the tension roller 211 by a biasing unit (not shown) while the tension roller 211 is held by a holding unit 215. The photoreceptors 201 to 204 are disposed, in the order of the photoreceptor 201, the photoreceptor 202, the photoreceptor 203, and the photoreceptor 204, starting from downstream along the intermediate transfer belt 230.

Onto the driving roller 212, a secondary transfer roller 210, to which a predefined voltage is applied, is disposed. The toner image formed on the intermediate transfer belt 230 is transferred onto a sheet 214 by the secondary transfer roller 210, and is fixed. A residual toner that remains on the intermediate transfer belt 230 after the transfer of the toner image by the secondary transfer roller 210 is collected by a cleaning unit 213. The tension roller 211 and the driving roller 212 are equal in diameter, and the diameters are configured to be 14 millimeters or above.

In the transfer unit 200, the holding unit 215 that holds the tension roller 211 by a shaft 215*a* is horizontally installed. In the holding unit 215, an image reading sensor 216 is installed facing against the tension roller 211. Thus, the toner image on the intermediate transfer belt 230 can be detected by the image reading sensor 216.

A roller for the image reading sensor is not required, because the image reading sensor 216 is installed facing to the tension roller 211. Thus, the intermediate transfer belt maintains the tension of which by only two axes, or the driving roller 212 and the tension roller 211, which brings cost reduction and downsizing of the transfer unit 200. Also, because the tension roller 211 is disposed between the photoreceptor 201, which is located at the most downstream position among the photoreceptors 201 to 204, and the secondary transfer unit, the image detection by the image reading sensor 216 is performed before the secondary transfer. Thus, a unit that moves the secondary transfer roller 210 to and away from the intermediate transfer belt 230 can be omitted, which further brings cost reduction and downsizing of the transfer unit 200.

Because the diameters of the tension roller 211 and the driving roller 212 are equal, when the tension roller 211 generates an unexpected driving force, an uneven pitch can be absorbed by the pitch among the photoreceptors 201, 202, 203, and 204, enabling to avoid a color shifting. Also, the diameter of the tension roller 211 is 14 millimeters or more, which ensures enough accuracy of the image detection.

Figure 3:
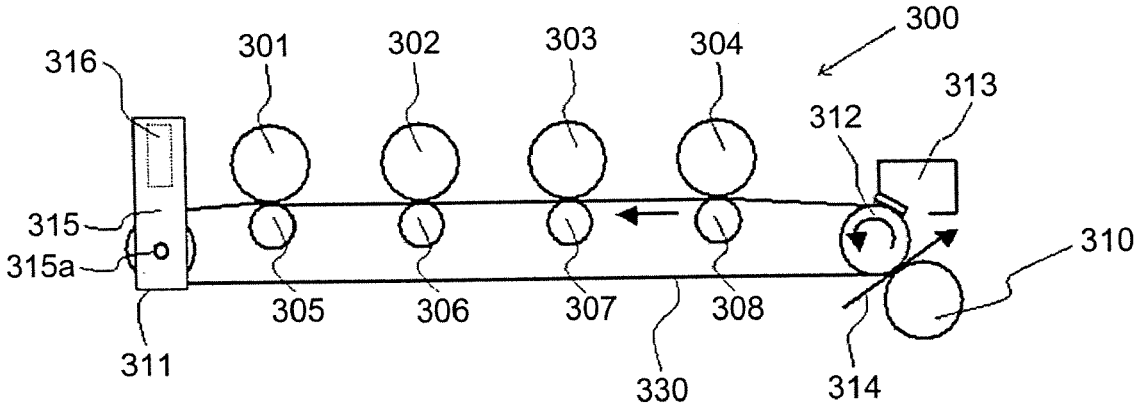
FIG. 3 is a schematic diagram of a transfer unit according to a second embodiment of the present invention.

FIG. 3 is a schematic diagram of a transfer unit 300 according to a second embodiment of the present invention. The transfer unit 300 includes four photoreceptors 301, 302, 303, and 304, primary transfer rollers 305, 306, 307, and 308, a tension roller 311, a driving roller 312, a secondary transfer roller 310, a cleaning unit 313, and an intermediate transfer belt 330, similar to the transfer unit 200 according to the first embodiment.

The tension roller 311 is held by a holding unit 315 that extends at an upper position to the tension roller 311. The holding unit 315 includes an image reading sensor 316 disposed at the upper position of the tension roller 311. The image reading sensor 316 can be disposed with neither increasing a height nor a width of the transfer unit 200. The positions to which the image reading sensor 316 can be disposed preside from horizontally upper to horizontally lower, and according to the first embodiment, the device width increases, while when disposed at a horizontally lower position, the device height increases.

According to the second embodiment, a minimum width and height of the intermediate belt unit is enabled. The image reading sensor 316 can be at any position around the tension roller 311.

According to the first embodiment, the image reading sensor 216, which is located at the side of the tension roller 211, makes the width of the transfer unit 200 wider. If the image reading sensor 316 is located downward of the tension roller 311, the length of the transfer unit 300 becomes long. According to the second embodiment, because the image reading sensor 316 is located upward of the tension roller 311, or in the side of the photoreceptors 301 to 304, the dimension of the transfer unit 300 is minimized.

Figure 4:
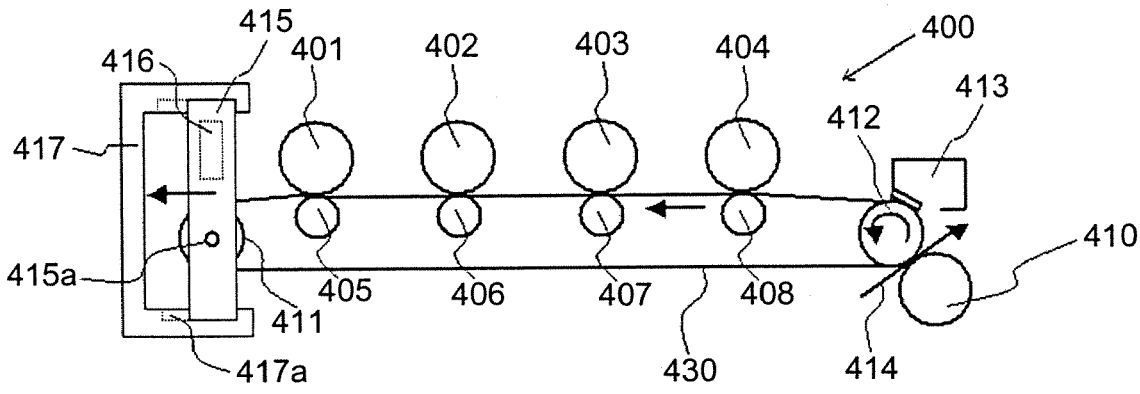
FIG. 4 is a schematic diagram of a transfer unit according to a third embodiment of the present invention.
Figure 5:
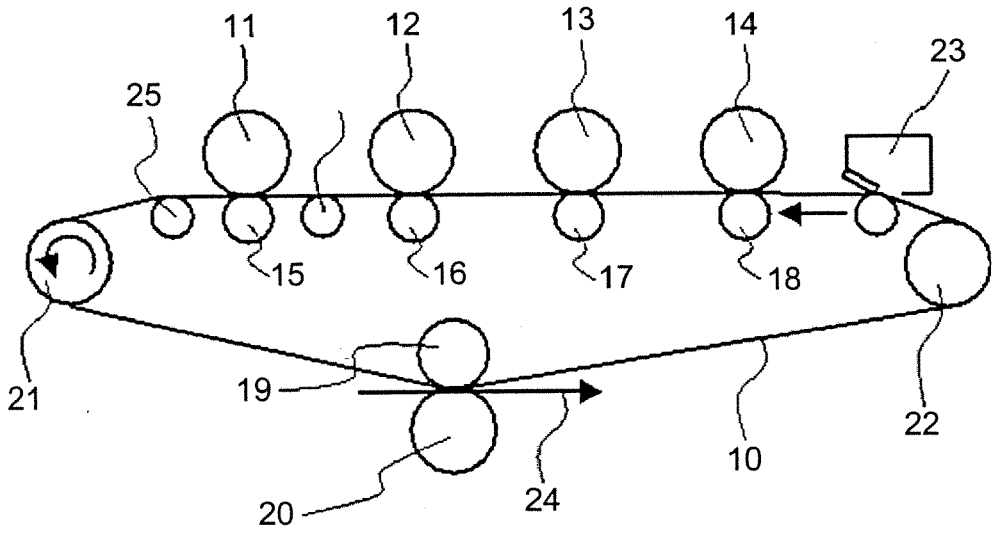
FIG. 5 is a schematic diagram of a conventional transfer unit.

FIG. 4 is a schematic diagram of a transfer unit 400 according to a third embodiment of the present invention. The transfer unit 400 includes four photoreceptors 401, 402, 403, and 404, primary transfer rollers 405, 406, 407, and 408, a tension roller 411, a driving roller 412, a secondary transfer roller 420, a cleaning unit 413, and an intermediate transfer belt 430, similar to the transfer unit 200 in the first embodiment.

A holding unit 415 including an image reading sensor 416 is attached to a chassis 417. An allowance for the holding unit 415 to move is formed within the chassis 417, so that the holding unit 415 is vertically fixed, but can move horizontally in a biasing direction (a direction indicated with arrow in FIG. 4).

According to the third embodiment, a relative position between the image reading sensor 416 and the intermediate transfer belt 430 can be maintained constant, so that a solution to the issue of a position difference of the conventional image reading sensors is provided by the image reading sensor 416 that ensures the accuracy in detection.

As describe above, according to an embodiment of the present invention, it is possible to lower cost and downsize a transfer unit and an image forming apparatus including an image reading sensor.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer unit comprising:

a plurality of image carriers on which latent images of different colors are formed, respectively;

an intermediate transfer belt of an endless type, on which the latent images are superimposed to form a full color toner image;

a tension roller that maintains a tension of the intermediate transfer belt;

a driving roller that drives the intermediate transfer belt;

a biasing unit that applies the tension to the tension roller;

a holding unit that holds the tension roller; and an image reading sensor that detects the toner image formed on the intermediate transfer belt, wherein the image reading sensor is disposed in the holding unit, in an opposite position to the tension roller with respect to the intermediate transfer belt.

2. The transfer unit according to claim 1, wherein the intermediate transfer belt is tightly supported by the tension roller and the driving roller, and a diameter of the driving roller is the same as a diameter of the tension roller.

3. The transfer unit according to claim 1, wherein the diameter of the tension roller is equal to or longer than 14 millimeters.

4. The transfer unit according to claim 1, wherein the image reading sensor is disposed above the tension roller in a vertical direction.

5. The transfer unit according to claim 1, further comprising:

a chassis that encloses the intermediate transfer belt, the tension roller, the driving roller, the biasing unit, and the holding unit, wherein a relative position between the image reading sensor and the intermediate transfer belt is ensured to be constant.

6. The transfer unit according to claim 1, further comprising:

a secondary transfer roller that is disposed in an opposite position to the driving roller with respect to the intermediate transfer belt, wherein the secondary transfer roller is constantly making a contact with the intermediate transfer belt.

7. An image forming apparatus comprising:

a transfer unit that includes a plurality of image carriers on which latent images of different colors are formed, respectively;

an intermediate transfer belt of an endless type, on which the latent images are superimposed to form a full color toner image;

a tension roller that maintains a tension of the intermediate transfer belt;

a driving roller that drives the intermediate transfer belt;

a biasing unit that applies the tension to the tension roller;

a holding unit that holds the tension roller; and an image reading sensor that detects the toner image formed on the intermediate transfer belt, wherein the image reading sensor is disposed in the holding unit, in an opposite position to the tension roller with respect to the intermediate transfer belt.

* * * * *